US008013698B2

(12) United States Patent
Bonjean et al.

(10) Patent No.: US 8,013,698 B2
(45) Date of Patent: Sep. 6, 2011

(54) PERMANENT-MAGNET MAGNETIC ACTUATOR OF REDUCED VOLUME

(75) Inventors: Marc Bonjean, Villevieille (FR); Pierre Leroy, Baillargues (FR)

(73) Assignee: Areva T&D SA, Paris (FR)

( * ) Notice: Subject to any disclaimer, the term of this patent is extended or adjusted under 35 U.S.C. 154(b) by 0 days.

(21) Appl. No.: 11/623,518

(22) Filed: Jan. 16, 2007

(65) Prior Publication Data

US 2007/0171016 A1 Jul. 26, 2007

(30) Foreign Application Priority Data

Jan. 20, 2006 (FR) ..... 06 50208

(51) Int. Cl.
*H01F 7/08* (2006.01)
*H01F 7/00* (2006.01)

(52) U.S. Cl. ..... 335/229; 335/220; 335/234

(58) Field of Classification Search ..... 335/229, 335/234, 220
See application file for complete search history.

(56) References Cited

U.S. PATENT DOCUMENTS

| | | | | |
|---|---|---|---|---|
| 3,775,715 | A | 11/1973 | Bosch et al. | |
| 4,157,520 | A * | 6/1979 | Moates et al. | 335/230 |
| 4,419,643 | A | 12/1983 | Ojima et al. | |
| 4,470,030 | A * | 9/1984 | Myers | 335/228 |
| 4,660,012 | A * | 4/1987 | Bonniau et al. | 335/234 |
| 4,910,487 | A * | 3/1990 | Kleinhappl | 335/234 |
| 5,268,662 | A * | 12/1993 | Uetsuhara et al. | 335/229 |
| 5,497,135 | A * | 3/1996 | Wisskirchen et al. | 335/253 |
| 6,009,615 | A * | 1/2000 | McKean et al. | 29/602.1 |
| 6,262,648 | B1 * | 7/2001 | Lammers | 335/229 |
| 6,459,349 | B1 * | 10/2002 | Giday et al. | 336/178 |
| 6,586,936 | B2 * | 7/2003 | Pittaluga et al. | 324/319 |
| 6,646,529 | B1 * | 11/2003 | Kahnert et al. | 335/229 |
| 6,816,048 | B2 * | 11/2004 | Morita et al. | 335/220 |
| 6,933,827 | B2 * | 8/2005 | Takeuchi et al. | 336/212 |
| 6,940,376 | B2 * | 9/2005 | Morita et al. | 335/220 |
| 7,075,398 | B2 * | 7/2006 | Morita et al. | 335/220 |
| 7,102,475 | B2 * | 9/2006 | Nakagawa et al. | 335/234 |
| 7,182,051 | B2 * | 2/2007 | Sedda et al. | 123/90.11 |
| 7,301,426 | B2 * | 11/2007 | Lammers | 335/234 |
| 2002/0057153 | A1 * | 5/2002 | Matsusaka et al. | 335/220 |
| 2002/0105397 | A1 * | 8/2002 | Turner et al. | 335/160 |
| 2004/0027775 | A1 | 2/2004 | Lang | |
| 2005/0088265 | A1 * | 4/2005 | Nakagawa et al. | 335/220 |

FOREIGN PATENT DOCUMENTS

| | | |
|---|---|---|
| DE | 27 42 987 | 4/1979 |
| EP | 0 380 693 A1 | 8/1990 |
| EP | 1 225 609 A2 | 7/2002 |
| FR | 2 504 718 | 10/1982 |
| JP | 2003-308761 | 10/2003 |
| WO | WO 96/32734 | 10/1996 |

* cited by examiner

*Primary Examiner* — Elvin G Enad
*Assistant Examiner* — Alexander Talpalatskiy
(74) *Attorney, Agent, or Firm* — Oblon, Spivak, McClelland, Maier & Neustadt, L.L.P.

(57) ABSTRACT

A magnetic actuator comprises at least one coil surrounded by a magnetic circuit. The magnetic circuit possesses three legs and two facing end plates. The three legs comprise two outer legs on either side of the coil and an intermediate leg passing through the coil. The legs have no direct mechanical contact with one another. The two facing end plates magnetically interconnect the three legs. The magnetic circuit comprises a moving armature comprising at least one of the end plates, and a stationary portion including a yoke having at least the other one of the end plates and at least one permanent magnet. The permanent magnet is placed at one end of the intermediate leg beside the end plate of the yoke. The magnetic actuator can control medium-voltage and high-voltage circuit breaker vacuum chambers.

15 Claims, 11 Drawing Sheets

Prior Art

PERMANENT-MAGNET MAGNETIC ACTUATOR OF REDUCED VOLUME

TECHNICAL FIELD

The present invention relates to a permanent-magnet magnetic actuator serving in particular for controlling vacuum "chambers" in medium-voltage or high-voltage circuit breakers. The invention also relates to a mechanism for controlling the contacts of one or more circuit breaker vacuum chambers, which mechanism is provided with such an actuator.

STATE OF THE PRIOR ART

Permanent-magnet magnetic actuators include so-called "plane geometry" actuators, e.g. the actuator described in patent application WO 96/32734 which is shown in section in FIG. 1. The term "plane geometry" means that the different sections on a plurality of substantially parallel planes of the magnetic circuit of the actuator are of substantially isometric, and superposable. This term "plane geometry" is used to distinguish from actuators in which the geometry is axially symmetrical. The drawback of actuators that are axially symmetrical, such as the actuator described in patent application EP-A-1 225 609, or even in patent application FR-A-2 504 718 which relates to a self-holding solenoid, is that they are difficult to modulate so as to obtain a range of actuators for providing different drive forces. The main parts as constituted by the yoke, the armature, and the permanent magnets cannot be reused. The magnets are in the form of circular arcs, and they are therefore not easy to make. In contrast, with so-called "plane geometry" actuators, it is easy to provide a range of actuators having different drive forces, while reusing certain parts such as the yoke, the armature, and the permanent magnet. They all have the same section, it is only their thickness that varies, and this thickness can be obtained by placing a plurality of basic elements side by side.

The actuator of patent application WO 96/32734 is suitable for driving one or more vacuum chambers in a circuit breaker. The actuator comprises a magnetic circuit 1 co-operating with two spaced-apart coils 2 that are coaxial about a common axis. The magnetic circuit is in the form of two E-shapes 3 placed facing each other, together with a leg 4 between the two E-shapes. Each E-shape possesses one side leg 3.4 and three transverse bars 3.1, 3.2, 3.3 comprising two end bars 3.1, 3.3 and one intermediate bar 3.2, the end transverse bars 3.1 and 3.3 being longer than the intermediate transverse bar 3.2. The leg 4 is housed in part in a space defined by the two E-shapes and it provides a magnetic connection between the two end transverse bars 3.1 and 3.3 of a given E-shape 3. It is moved between the two end transverse bars 3.1 and 3.3 of a given E-shape 3.

The magnetic circuit 1 is embodied by a moving armature 7 and a stationary yoke 5 associated with one or more pairs of permanent magnets 6 that are likewise stationary. The armature 7 corresponds to the leg 4 of the magnetic circuit 1, and it extends along an axis x-x'. The yoke 5 and the pairs of magnets 6 correspond to the E-shapes. Each magnet 6 is housed in an intermediate transverse bar 3.2 of an E-shape between two segments of the yoke 5.

In section view, an axially symmetrical magnetic actuator would look similar, but with that architecture, the magnetic circuit would comprise two coaxial cylinders placed one within the other, the outer cylinder being closed at its ends by covers.

A drawback of the FIG. 1 actuator is that magnetic flux that becomes established in the magnetic circuit, in particular because of the presence of the magnets 6, passes between the armature 7 and the yoke 5 transversely to the axis x-x'. Any small lateral asymmetry in this magnetic flux causes the armature 7 to move sideways and turn about the axis x-x' towards the intermediate bar 3.2 of one of the E-shapes, thereby reinforcing the lateral asymmetry of the flux and thus of the forces. These interfering transverse forces generate friction that must be overcome when the armature is caused to move in order to go from one of its stable positions to its other stable position. It is necessary to provide guide parts for the armature, made of a material having a low coefficient of friction, with these parts being inserted between the armature and the free ends of the intermediate transverse bars of the E-shapes. These parts need to be mounted with accurate positioning, and that is difficult.

Another drawback of this actuator is that it is bulky and uses a large amount of material for a given drive force.

Yet another drawback of the actuator is that the stroke of its armature is limited since it takes place between the end transverse bars of a given E-shape.

In the other two above-mentioned patent applications, at certain moments that depend on the position of the armature, the actuator is likewise subjected to interfering radial forces and to friction that needs to be taken into account.

SUMMARY OF THE INVENTION

The present invention seeks to provide a permanent-magnet magnetic actuator of "plane geometry" that avoids the limitations and difficulties mentioned above. This object is achieved by proposing an actuator in which the configuration of the magnetic circuit is such that the magnetic flux entering and the magnetic flux leaving the armature are oriented along the axis of the intermediate leg and use is made of both fluxes, thereby enabling the drive force of the actuator to be increased for given sections of the intermediate leg and of the armature. It is recalled that the drive force of an actuator is the force exerted on the armature when moving in translation, and that it can be expressed approximately by the relationship $$F=40\cdot B^2\cdot A$$

where B is the induction of the coil in teslas (T) A is the area of the airgaps between the armature and the remainder of the magnetic circuit in square centimeters ($cm^2$), and where the force F is expressed in newtons (N).

More precisely, the actuator of the invention comprises at least one coil surrounded by a magnetic circuit possessing:

three legs, comprising two outer legs on either side of the coil, and an intermediate leg passing through the coil, these legs having no direct mechanical contact with one another; and two facing end plates magnetically interconnecting the three legs;

the actuator being characterized in that the magnetic circuit comprises a moving armature comprising at least one of the end plates, and a stationary portion including a yoke having at least the other one of the end plates and at least one permanent magnet, the permanent magnet being placed at one end of the intermediate leg beside the end plate of the yoke.

The armature and the stationary portion are substantially complementary in shape with respect to the three legs.

Preferably, to ensure good passage of the magnetic flux, the stationary portion further includes a flux guide part inserted in the intermediate leg between the magnet and the armature.

Preferably, the flux guide part is made of an iron-based material.

The flux guide part may comprise two portions, one of the portions being of substantially constant section and extending inside the coil, and the other portion being of increasing section and extending from the coil towards the magnet.

The armature may be in the form of a plate, a T shape, a U-shape, or an E-shape.

The yoke may be in the form of a plate, a T-shape, a U-shape, or an E-shape.

The armature and/or the yoke may include, at least in part, the intermediate leg and/or the outside legs.

When the actuator is in the closed position, the armature comes mechanically into contact with the yoke, at least via the two outside legs.

It is possible for the yoke and/or the armature to be laminated, thus making it easier for the actuator to be made in modular form.

The yoke and/or the armature and/or the permanent magnet are built up of a plurality of touching parts.

When the yoke is U-shaped, it may be made up of two L-shaped parts touching each other face to face.

When the armature is T-shaped, it may be made up of two L-shaped parts, touching each other back to back.

It is advantageous for the end plate of the yoke to include a groove in its face remote from the magnet in order to make it easier to secure the actuator on a support.

The actuator may be provided with one or more fastening flanges secured to the yoke.

The present invention also provides a mechanism for controlling the contacts of one or more circuit breaker vacuum chambers, the mechanism including an actuator as defined above.

BRIEF DESCRIPTION OF THE DRAWINGS

The present invention can be better understood on reading the following description of embodiments given purely by way of non-limiting example and making reference to the accompanying drawings, in which.

It should be understood that the various embodiments are not mutually exclusive. Portions that are identical, similar, or equivalent amongst the various figures described below are given the same numerical references so as to make it easier to go from one figure to another. The various portions shown in the figures are not necessarily all to the same scale, in order to make the figures more readable.

DETAILED DESCRIPTION OF PARTICULAR EMBODIMENTS

There follows a description of a first configuration for an actuator of the invention.

Figure 1:
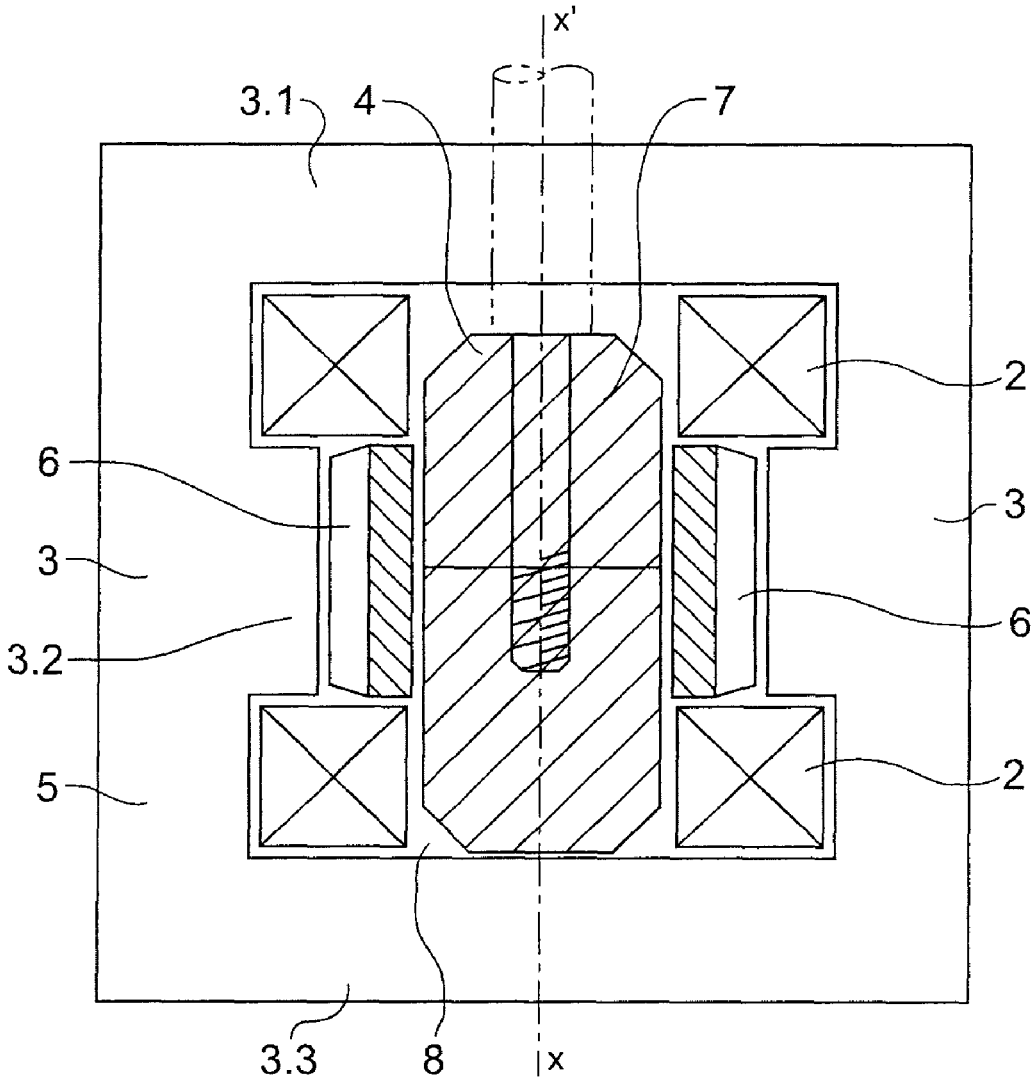
FIG. 1 shows a prior art actuator.
Figure 2A:
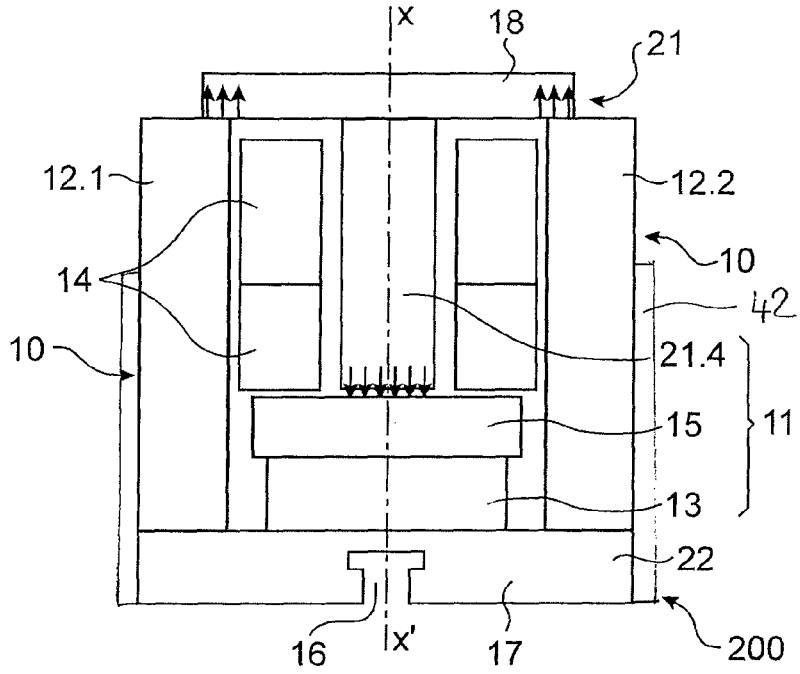
FIGS. 2A and 2B are section views of a first embodiment of an actuator of the invention shown in the open position and in the closed position.
Figure 2B:
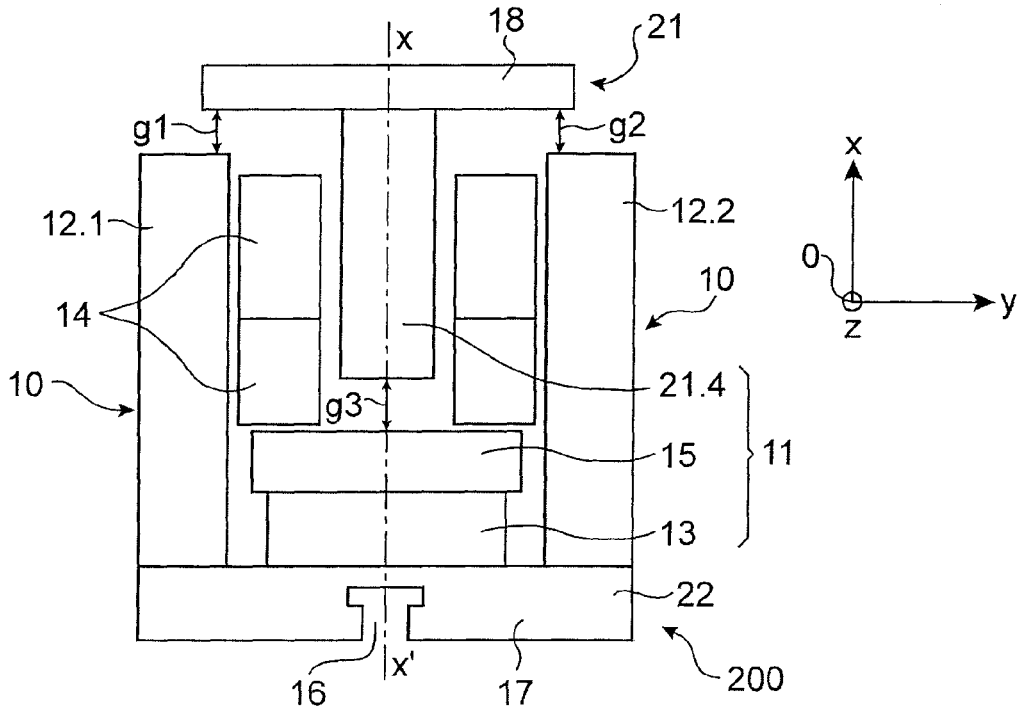

Reference is made to FIGS. 2A and 2B which are section views of a first embodiment of a magnetic actuator of the invention in two stable positions. The actuator is bistable. In FIG. 2A, it is in one stable position under the action of magnetic coupling forces, this position being the closed position. In FIG. 2B, it is in its other stable position, this time under the action of springs tending to separate the armature and the yoke, and developing a force that is greater than the force coming from the magnetic coupling in this position, this being the open position.

The term "bistable" is used to mean that the actuator possesses two positions that are stable in the absence of current in the coil. It is possible to envisage an actuator that is not bistable. For example, provision could be made for the closed position to be held only providing some small residual current continues to flow in the coil. Interrupting this current would then cause the force balance to change over and cause the actuator to open.

The actuator includes at least one coil 14 surrounded by a magnetic circuit 10 possessing three legs 11, 12.1, and 12.2, where two of the legs 12.1 and 12.2 are lateral being outside the coil 14, and one of the legs, 11, is intermediate and passes through the coil 14, at least in the closed position. The magnetic circuit also has two end plates 17, 18 facing each other and magnetically interconnecting the legs 12.1, 12.2, 11 so as to close the magnetic circuit 10, in particular when the actuator is in the closed position. The legs 12.1, 12.2, and 11 are not directly in mechanical contact with one another. The two outside legs 12.1 and 12.2 extend substantially perpendicularly to the two end plates 17 and 18. When the actuator is in its stable open position, the magnetic circuit 10 is open, and three airgaps g1, g2, and g3 are formed therein, each leg 12.1, 12.2, and 11 co-operating with a respective airgap g1, g2, and g3. These airgaps g1, g2, and g3 extend in the direction in which the armature 21 moves. The coil 14 serves to generate a magnetomotive force which increases or decreases the magnetic field generated by the permanent magnet 13, depending on whether it is desired to open or close the actuator.

The magnetic circuit 10 is embodied by a stationary portion 200 comprising at least one yoke 22 associated with at least one permanent magnet 13, and by a moving portion or armature 21. The yoke 22 includes at least one of the end plates 17, while the armature 21 includes the other end plate 18. The permanent magnet 13 is at one end of the intermediate leg 11 beside the end plate 17 of the yoke 22. The permanent magnet 13 may be of the rare earth type, e.g. being based on neodymium, iron, and boron.

The moving portion 21 and the stationary portion 200 are substantially complementary in shape so that the magnetic circuit 10 can be closed by minimizing the sizes of the airgaps, at least when the magnetic actuator is in the closed position.

The arrows drawn in FIG. 2A represent the magnetic flux entering and leaving the actuator 21. This flux extends along the same axis as the axis along which the armature 21 moves, but not necessarily in the same direction as the force that is applied to the armature 21, and thus not necessarily in the same direction as the armature 21 moves. This flux has at any moment no transverse component to the displacement. This characteristic does not exist in the prior art.

It is preferable for the stationary portion 200 to include in addition a magnetic flux guide part 15 that is inserted between the permanent magnet 13 and the armature 21. This flux guide part 15 is a portion of the intermediate leg 11. It serves to concentrate the magnetic flux coming from the magnet 13 towards the armature 21. This flux guide part 15 contributes to defining one of the airgaps g3. This flux guide part 15 is preferably made of steel, since this material possesses maximum induction which value is about twice that of the rare earth type permanent magnet. The attraction force or drive force is proportional to the square of the induction as explained above, so it is advantageous to work for maximum induction in the airgap g3.

In the example of FIGS. 2A and 2B, the armature 21 is T-shaped and the yoke 22 is U-shaped. The T-shape comprises a main bar 21.4 and a cross-bar. The main bar 21.4 is a portion of the intermediate leg 11, and the cross-bar is the end plate 18. The U-shape comprises two sides and a bottom. The sides of the U-shape are the outside legs 12.1 and 12.2, and the bottom of the U-shape is the end plate 17. Going from the end plate 17 of the yoke 22, the intermediate leg 22 is made up of: the magnet 13; the flux guide part 15; and the main bar 21.4 of the armature 21. The permanent magnet 13 is substantially in the form of a rectangular parallelepiped, and so is the flux guide part 15. Other shapes could be used for the flux guide part 15, as shown in FIGS. 3A to 3F.

The airgaps g1 and g2 are situated between the free ends of the sides of the U-shape of the yoke 22 and the facing ends of the crossbar 18 of the T-shape of the armature 21. The third airgap g3 is situated between the free end of the main bar 21.4 of the T-shape of the armature 21 and the flux guide part 15. The coupling between this airgap g3 and the coil 14 is good that which makes it possible to reduce the electrical or mechanical power needed for opening purposes.

When the actuator is closed as shown in FIG. 2A, the armature 21 is in abutment against the yoke 22, and mechanical contact preferably takes place between the end plate 18 of the armature 21 and the ends of the two sides of the U-shape of the yoke 22, rather than between the armature 21 and the flux guide part 15. This avoids any impacts against the magnet 13 which is fragile. In any event, the flux guide part 15, when present, also serves to protect the magnet 13. When there is contact between the armature 21 and the yoke 22, the airgap g3 is as small as possible. It could even be zero. The airgaps g1 and g2 determine the stroke of the armature 21.

The yoke 22 may be made using a plurality of parts placed side by side. These parts may be in the form of rectangular parallelepipeds. For example, as shown in the example of FIGS. 2A and 2B, these parts may be the end plate 17 and the two outside legs 12.1 and 12.2. These parts 17, 12.1, and 12.2 may be solid or laminated, i.e. each of them may be made up of a stack of laminations. In a variant, it is possible for the yoke 22 to be made up of a pair of L-shaped parts placed face to face in order to build up the U-shape. These L-shaped parts are then symmetrical about a plane of symmetry xoz of the T-shape of the armature 21. These L-shaped parts may be solid or laminated.

Similarly, the armature 21 may be made up of a plurality of parts in the form of rectangular parallelepipeds placed side by side. In the example described, these parts comprise the end plate 18 and the main bar 21.4 of the T-shape. These parts may be solid or laminated. In a variant, the armature 21 may be made up of a pair of L-shaped parts placed back to back. These L-shaped parts are then symmetrical about the plane of symmetry. These L-shaped parts may be solid or laminated. The advantage of using laminated parts for the yoke and for the armature is that a greater or smaller number of laminations can be stacked together in order to build up a range of several different actuators.

Concerning the magnet 13, it may be made up as a single block or as a plurality of blocks placed side by side, these blocks being in the form of rectangular parallelepipeds. This characteristic cannot be seen in FIGS. 2A and 2B, but the parts could be placed one after another in the direction perpendicular to the plane of the sheet. This is shown diagrammatically in FIG. 5B.

As a result, a plurality of actuators presenting different drive forces can be made by using different thicknesses for the stacking of the L-shaped parts, both of the armature and of the yoke.

It is possible to provide a groove 16 in a middle portion of the end plate 17 of the yoke 22, remote from the magnet 13. This groove 16 can enable the actuator to be secured to an external device. Alternatively, or in addition, it is possible to secure one or more flanges 42 to the yoke 22. These flanges 42 can be located level with the outside legs, at the ends of the stack (if the yoke is laminated). These flanges 42 serve to stiffen the actuator and also to fasten it. The flanges 42 can be seen in FIG. 2A.

Reference is now made to FIGS. 3A to 3F for describing other variant embodiments of an actuator of the invention.

Figure 3A:
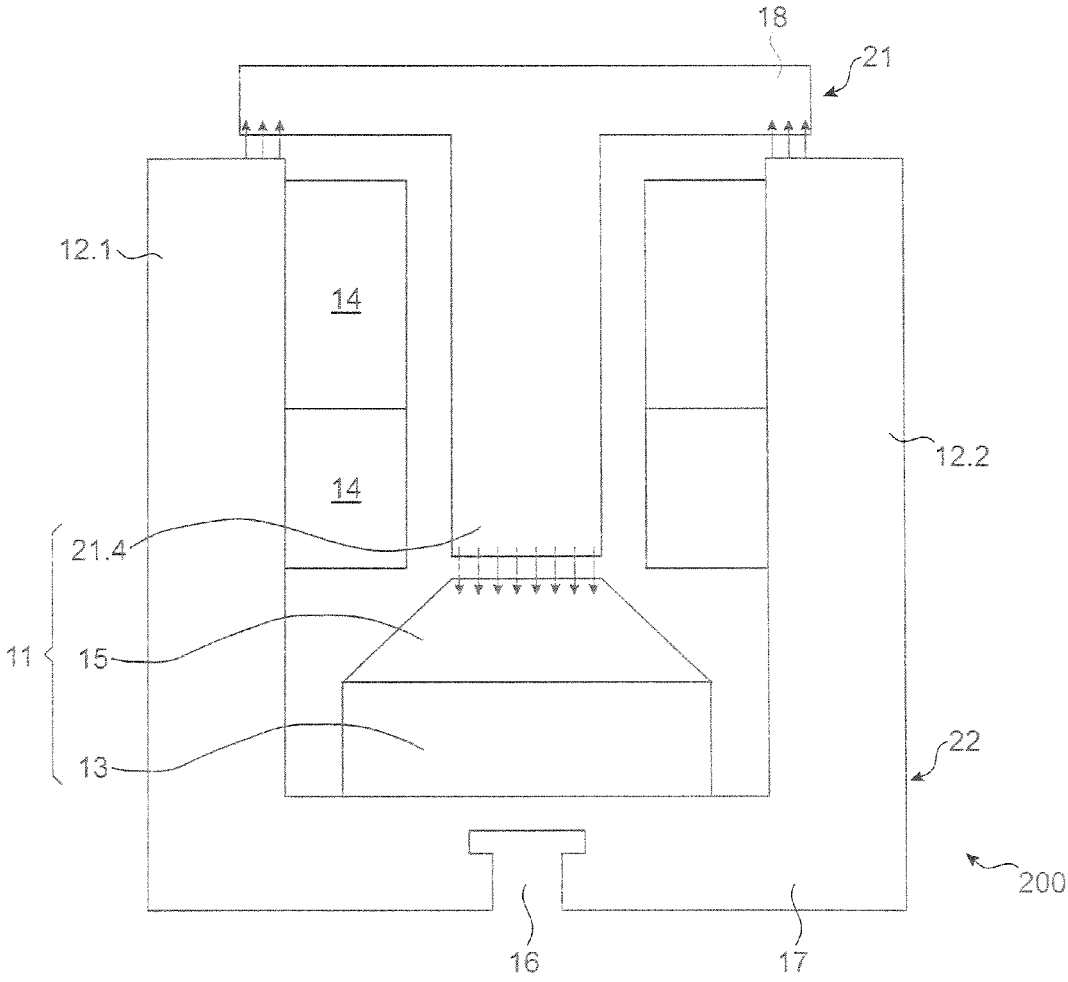
FIGS. 3A to 3F show six additional embodiments of an actuator in accordance with the invention.

In FIG. 3A, the yoke 22, the armature 21, and the magnet 13 are of shapes similar to those shown in FIGS. 2A and 2B. The flux guide part 15 is of section that is not constant: its face facing the permanent magnet 13 is of larger area than its face facing the armature 21 in order to concentrate the magnetic flux effectively towards the armature 21. Its section tapers in continuous manner going away from the magnet 13 towards the armature 21. The facing faces of the armature 21 and of the flux guide part 15 are of substantially equal areas in the configuration described. That is not essential.

Figure 3B:
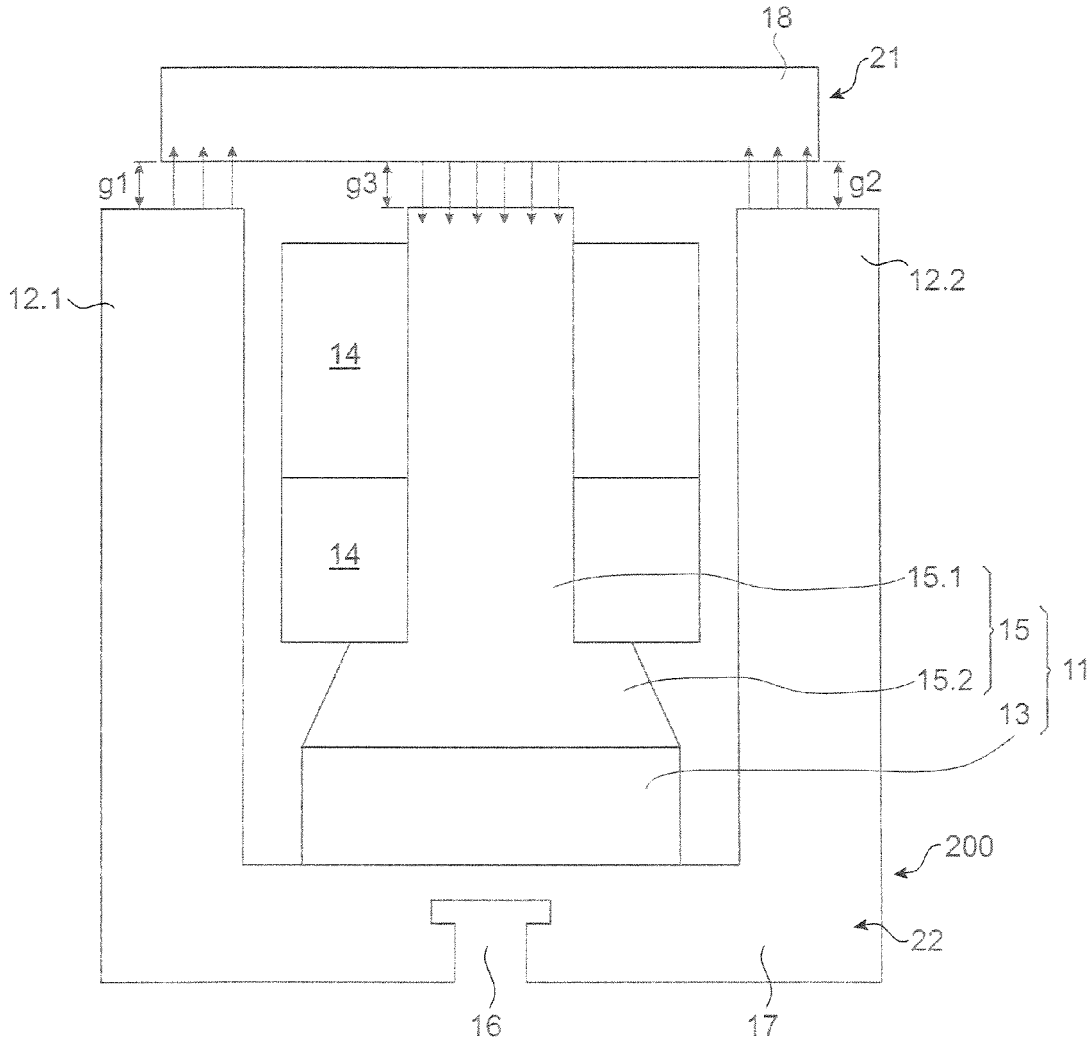

In FIG. 3B, the armature 21 is in the form of a plate, corresponding to the end plate 18. The stationary portion 200 comprises the U-shaped yoke 22, the permanent magnet 13, and the flux guide part 15. The U-shaped yoke 22 is similar to that of FIGS. 2A and 2B. The intermediate leg 11 is constituted solely by the permanent magnet 13 and by the flux guide part 15. The flux guide part 15 comprises two portions 15.1 and 15.2 that meet when they are end to end, a first portion 15.1 being of substantially constant section and a second portion 15.2 being of section that tapers going away from the magnet 13 towards the armature 21. The second portion 15.2 of tapering section lies between the magnet 13 and the coil 14. The two portions 15.1 and 15.2 do not have the same section where they meet. The second portion 15.2 is of larger section than the first portion 15.1. The second portion 15.2 of the flux guide part can thus serve as a support for the coil 14.

The airgaps g1 and g2 are situated between the free ends of the sides of the U-shape of the yoke 22 and the end plate 18 of the armature 21. The third airgap g3 is situated between the free end of the flux guide part 15 and the end plate 18 of the armature 21.

Figure 3C:
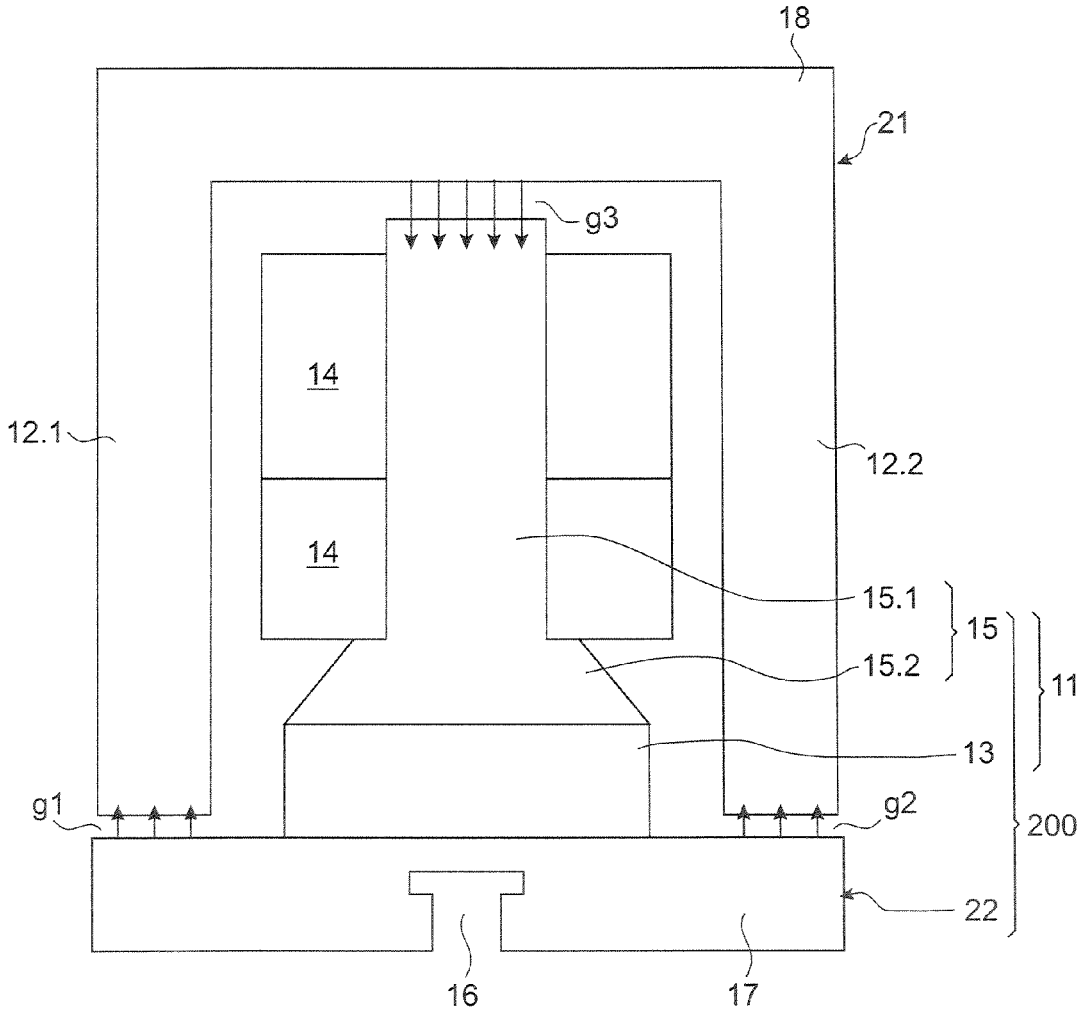

In FIG. 3C, the armature 21 is U-shaped, comprising the two outer side legs 12.1 and 12.2 together with the end plate 18. The stationary portion 200 comprises the yoke 22 in the form of a plate that corresponds to the end plate 17, together with the permanent magnet 13 and the flux guide part 15. The intermediate leg 11 is formed solely by the permanent magnet 13 and the flux guide part 15. This flux guide part 15 is similar to that shown in FIG. 3B. The airgaps g1 and g2 are situated between the free ends of the sides of the U-shape of the armature 21 and the end plate 18 of the yoke 22. The third airgap g3 is situated between the free end of the flux guide part 15 and the end plate 18 of the armature 21.

Figure 3D:
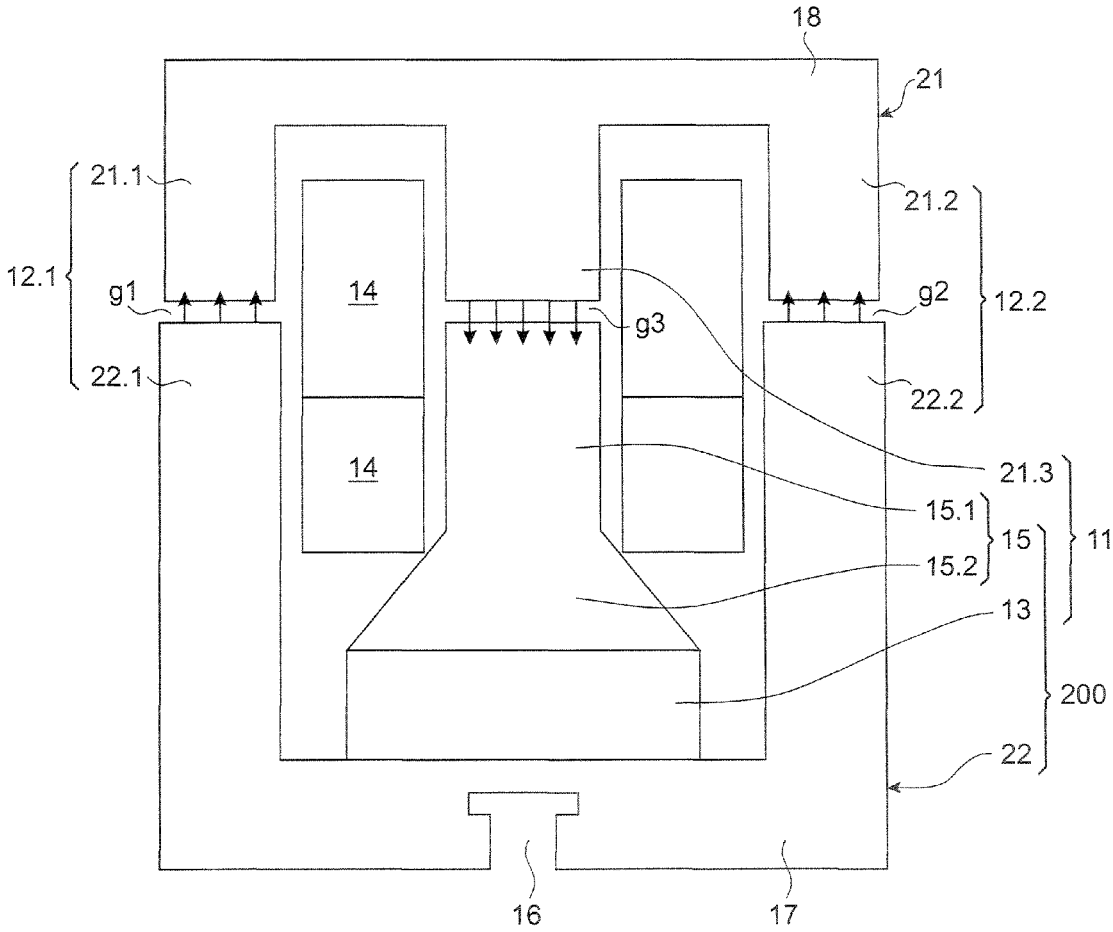

In FIG. 3D, the armature 21 is E-shaped, comprising two end segments 21.1 and 21.2, an intermediate segment 21.3, and the end plate 18. Each end segment 21.1 and 21.2 comprises a first segment of one of the outside legs 12.1 and 12.2, and the intermediate segment 21.3 is a first segment of the intermediate leg 11. The stationary portion 200 comprises the U-shaped yoke 22, the permanent magnet 13, and the flux guide part 15. The yoke 22 comprises a second segment 22.1, 22.2 of each of the outside legs 12.1, 12.2 together with the end plate 17. Going from the end plate 17 of the yoke 22, the intermediate leg 11 is made up of the permanent magnet 13, the flux guide part 15, and the intermediate segment 21.3 of the armature 21. This flux guide part 15 is similar to that of FIGS. 2A and 2B, but it is shorter because of the presence of the intermediate segment 21.3 of the armature 21. The airgaps g1 and g2 are situated between the free ends of the sides of the U-shape of the yoke 22 and the ends of the end segments 21.1 and 21.2 of the armature 21. The third airgap g3 is situated between the free end of the flux guide part 15 and the intermediate segment 21.3 of the moving armature 21.

Figure 3E:
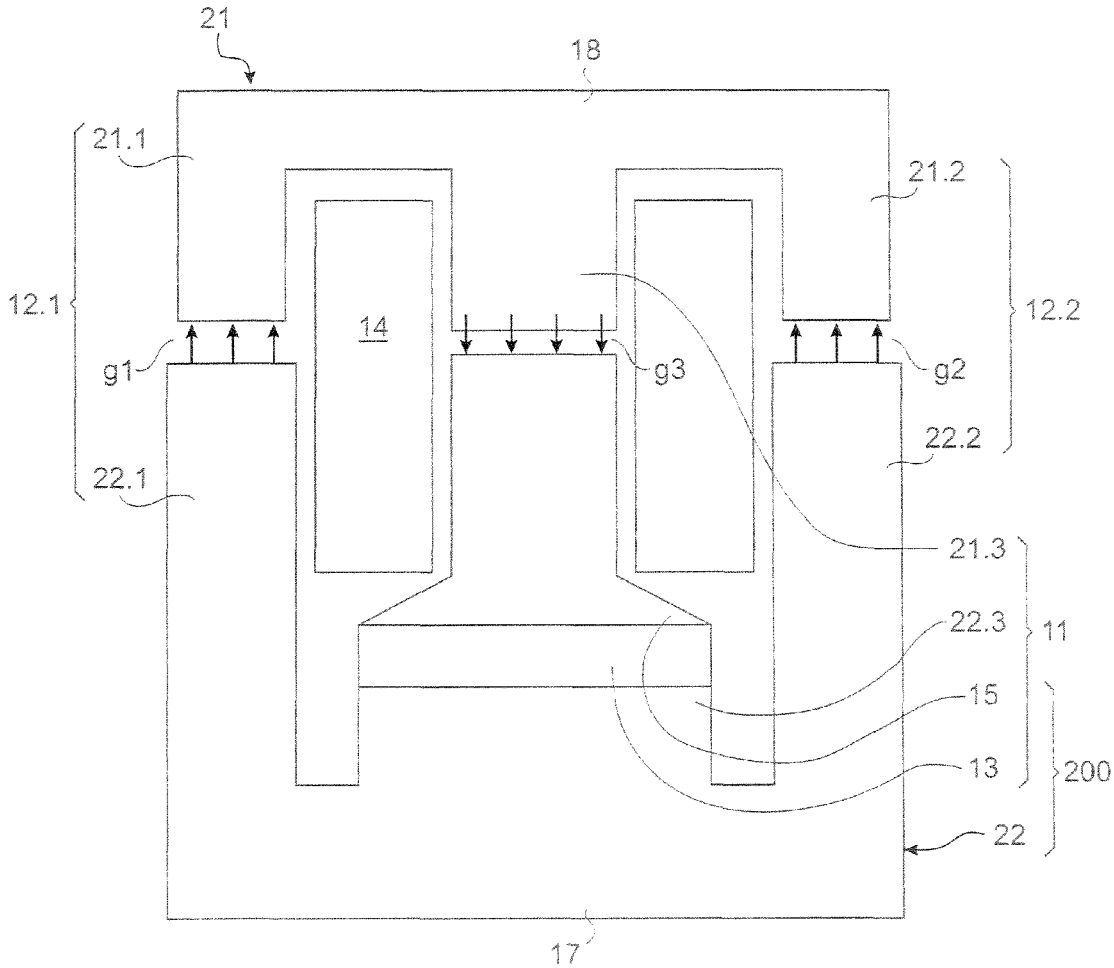

In FIG. 3E, the armature 21 is similar to that shown in FIG. 3D. The stationary portion 200 comprises the E-shape yoke 22, the permanent magnet 13, and the flux guide part 15. The yoke 22 comprises two end segments 22.1 and 22.2, an intermediate segment 22.3, and the end plate 17. Each end segment 22.1, 22.2 is a second segment of one of the outside legs 12.1, 12.2. The intermediate segment 22.3 of the yoke 22 is a second segment of the intermediate leg 11 which further comprises, going from said second segment: the permanent magnet 13; the flux guide part 15; and the intermediate segment 21.3 of the armature 21. The flux guide part 15 is similar to that of FIG. 3D but it is shorter because of the presence of the intermediate segment 22.3 of the yoke 22. The airgaps g1 and g2 are situated between the ends of the end segments 22.1, 22.2 of the yoke 22, and the ends of the end segments 21.1, 21.2 of the armature 21. The third airgap g3 is situated between the free end of the flux guide part 15 and the intermediate segment 21.3 of the armature 21.

Figure 3F:
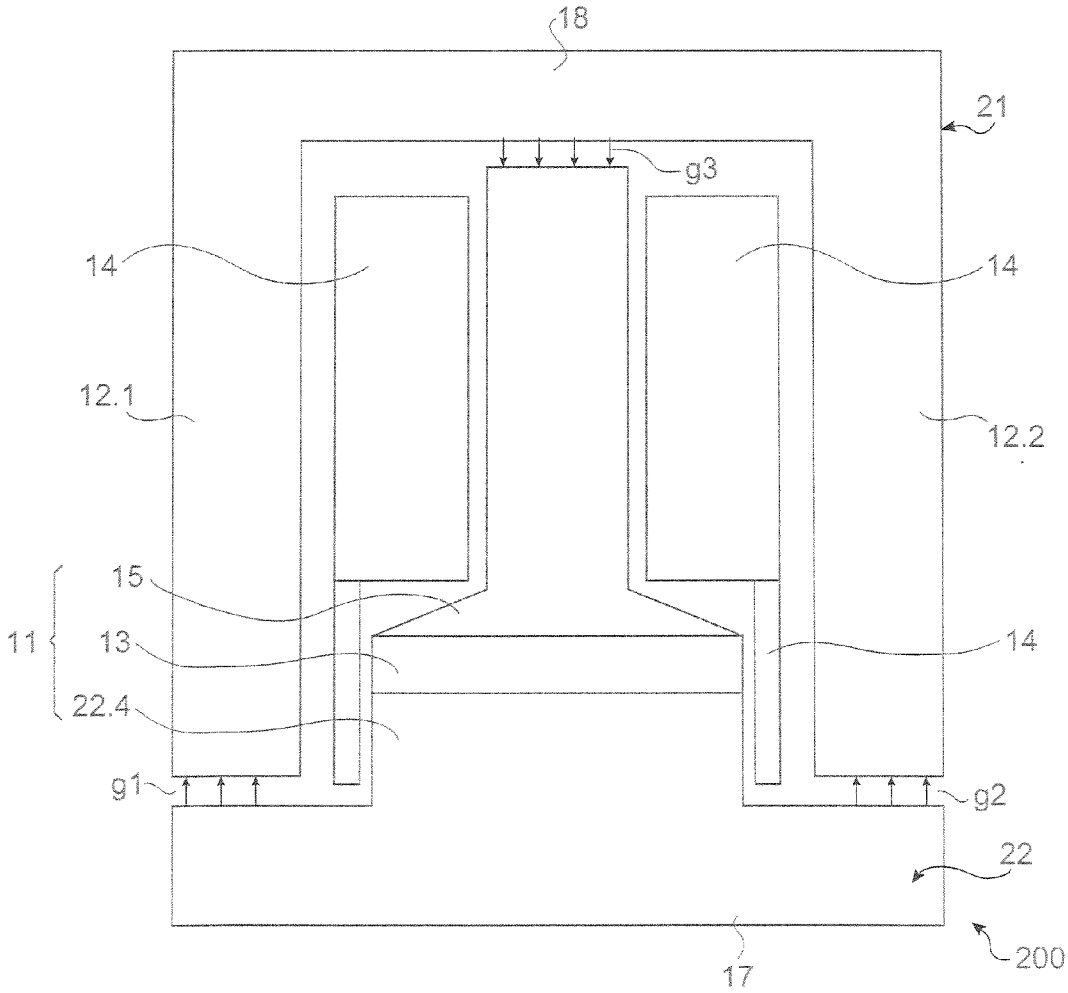

In FIG. 3F, the armature 21 is similar to that shown in FIG. 3C, and it is U-shaped. The stationary portion 200 comprises the yoke 22 which is T-shaped, the permanent magnet 13, and the flux guide part 15. The T-shaped yoke 22 comprises a main bar 22.4 and a cross-bar constituted by the end plate 17. The main bar 22.4 is a portion of the intermediate leg 11. The U-shaped armature 21 comprises two sides and an end wall. The sides of the U-shape form the outside legs 12.1 and 12.2, and the end wall of the U-shape is the end plate 18.

Going from the end plate 17 of the yoke 22, the intermediate leg 11 comprises: the main bar 22.4 of the yoke 22; the magnet 13; and the flux guide part 15. The airgaps g1 and g2 are situated between the cross-bar 17 of the yoke 22 and the ends of the outside legs 12.1, 12.2 of the armature 21. The third airgap g3 is situated between the free end of the flux guide part 15 and the end plate 18 of the armature 21. One or more coils 14 surround the assembly comprising the intermediate leg 11.

Figure 4A:
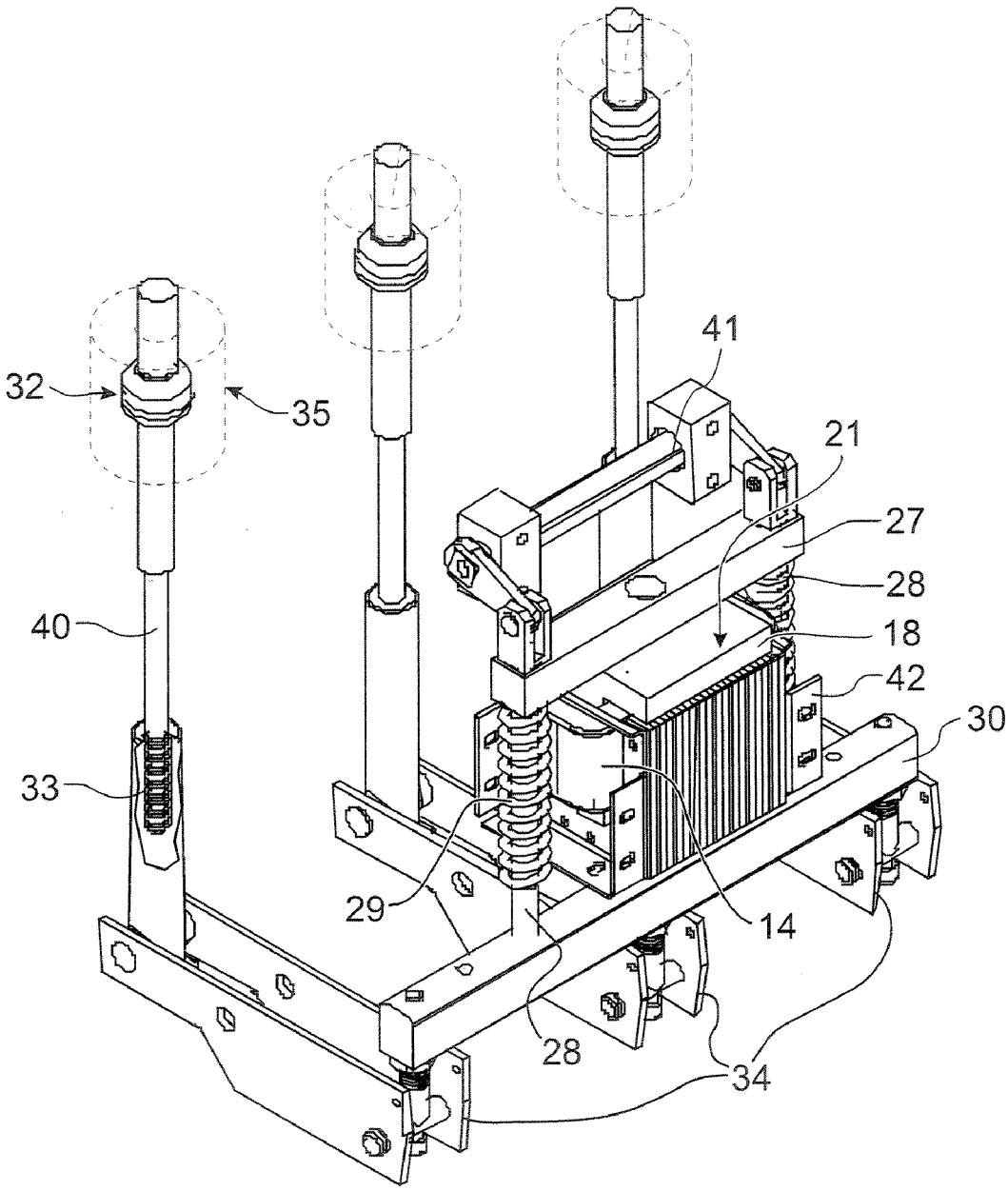
FIGS. 4A and 4B show an example of a mechanism for controlling the contacts of vacuum chambers, the mechanism being provided with an actuator of the invention, the actuator being shown in the closed position in FIG. 4A and in the open position in FIG. 4B.
Figure 4B:
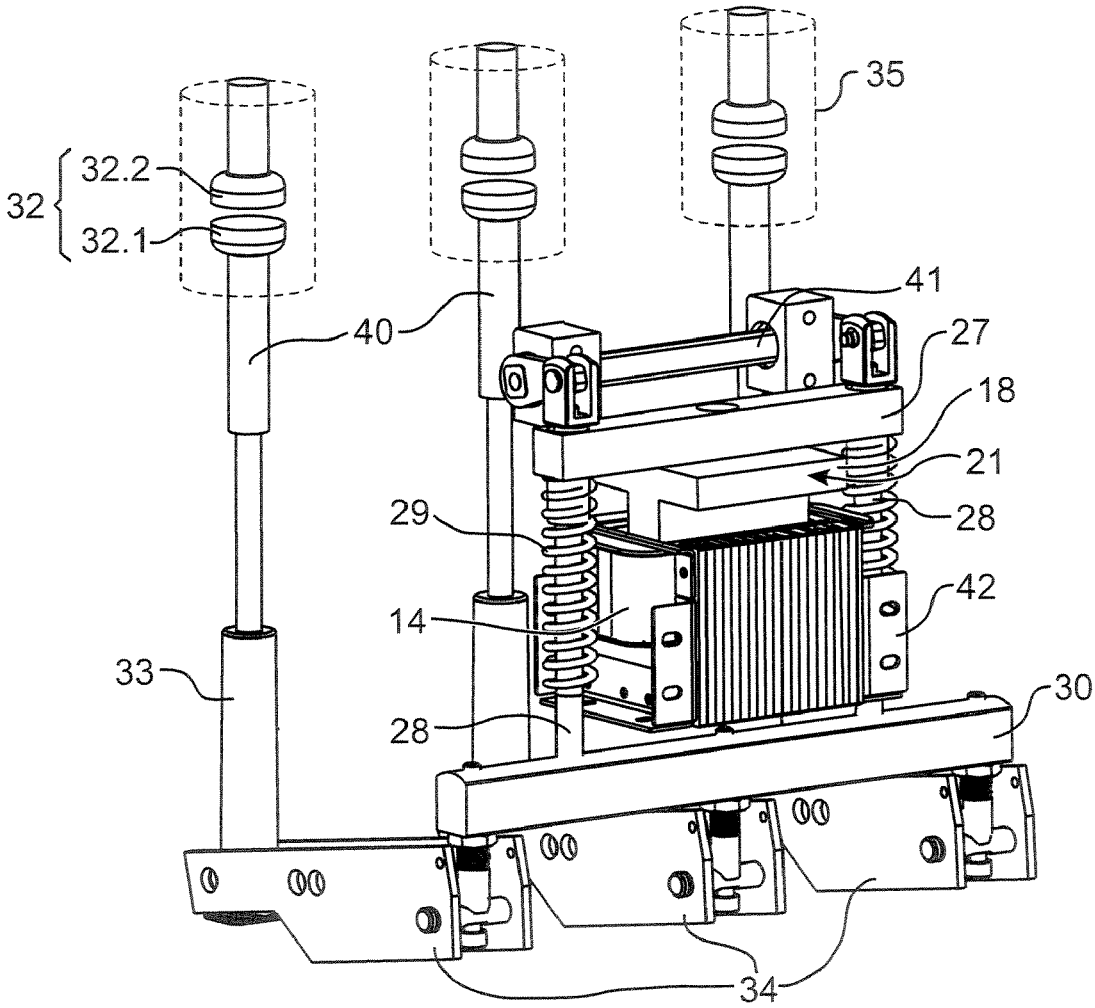

Below, reference is made to FIGS. 4A and 4B in order to describe a control mechanism that includes the actuator of the invention. In FIG. 4A, the actuator is closed, and in FIG. 4B it is open.

The control mechanism can be used for controlling a medium-voltage or high-voltage circuit breaker. Such circuit breakers comprise one or more pairs of contacts 32 placed in respective vacuum chambers 35, with each pair of contacts 32 comprising a moving contact 32.1 and a stationary contact 32.2.

The control mechanism comprises a first beam 27 for connecting securely to the armature 21 via its end plate 18. This first beam 27 is secured to a pair of shafts 28 extending substantially perpendicularly thereto, located at its ends on either side of the actuator. These shafts 28 are secured by a second beam 30 to as many levers 34 as there are vacuum chambers 35. The levers 34 serve to transmit movement that depends on the movement of the armature 21 to each of the moving contacts 32.1 of respective vacuum chambers 35 of the circuit breaker. These shafts 28 serve as guides for opening springs 29. The first beam 27 is also connected to an external guide system 41 of the anti-torsion bar type, the first beam 27 being suitable for pivoting about the anti-torsion bar 41. The first beam 27 is mounted substantially parallel to the anti-torsion bar 41. Because of this movement about the guide system 41, the first beam 27 is caused to drive the armature 21 with circularly arcuate movement instead of genuine movement in translation. Since the armature is not subjected to radial flux, having the armature 21 moved in this way is no drawback. Contact springs 33 are mounted on respective shafts 40 connecting respective levers 34 to the moving contact 32.1 of the circuit breaker.

The control mechanism operates as follows. It is assumed that the actuator is in the open position. The contacts 32 in each vacuum chamber 35 are held in the open position with the help of the opening springs 29 which are in extension. They are there to overcome the force due to the atmospheric pressure that acts on the contacts 32 of the vacuum chamber 35, this force being greater than the magnetic force exerted between the armature 21 and the yoke 22. In order to close the actuator and thus close the contacts 32 in the vacuum chambers 35, current is injected into the coil 14. This current may be obtained as a discharge from capacitor (not shown) mounted across the terminals of the coil 14. The current increases the magnetic fields created in the airgaps g1, g2, and g3 by the permanent magnet 13. The force of attraction that then acts on the armature 12 increases and becomes greater than the mechanical forces opposing movement of the armature 21. The armature 21 begins to move, thereby driving the moving contacts 32.1 of the vacuum chambers 35. The force of attraction urging the armature 21 towards the flux guide part 15 follows a complex relationship that depends on the lengths of the airgaps g1, g2 that define the stroke of the armature 21 and on the amplitude of the current flowing in the coil 14. The force that opposes movement of the armature 21 varies during the stroke of the actuator, in particular when the contacts 32 in the vacuum chambers 35 come into contact. Modern computer means make it possible to simulate the behavior of such a system completely and to optimize it.

The actuator and the contacts 32 of the vacuum chambers 35 are held closed by the magnetic force exerted by the armature 21, this force coming from the magnetic fields created by the permanent magnet (not visible in FIGS. 4A and 4B) in the airgap g3 at its minimum. There is no need for current to continue to flow in the coil 14. At this stage, the contact springs and the opening springs 29 are compressed.

The actuator, and thus the contacts 32 in the vacuum chambers 35, are opened by causing a current to flow in the coil 14. This flow of current takes place in the opposite direction to that used while closing the actuator, thereby creating a magnetic field that opposes the magnetic field of the magnet. This current flow comes from the capacitor discharging, the flow passing via a polarity-reversing switch, or else it comes from discharging another capacitor (not shown), or indeed it could come from the main power supply network, since the amount of energy required is small.

When there is a plurality of coils 14, one of them can be used for opening the actuator and the other for closing it. If there is only one coil, it needs to carry current in one direction or in the other depending on whether it is desired to open or close the actuator. FIGS. 3A to 3D show two coils, while FIGS. 3E and 3F show only one coil.

The driving magnetic force then decreases and becomes less than the mechanical forces applied to the armature 21 via the shafts 28 and the first beam 27. The armature 21 accelerates under drive from the contact and opening springs 33 and 29 which relax. The contacts 32 in the vacuum chambers 35 must be separated at a speed that is sufficient to interrupt any electric arc that might be struck. Unlike other architectures of the prior art, the actuator provides practically no energy during opening, so the springs need to be dimensioned accordingly.

The armature 21 is guided with the help of the anti-torsion bar 41 and the levers 34 which transmit its movement to the moving contacts 32.1 of the vacuum chambers 35.

It is possible to do without any current in the coil 14 in order to perform an opening operation, by applying an external mechanical force to the first bar 27 or to a part (not shown) rigidly connected to the moving armature 21, with this force being sufficient to oppose the magnetic force applied to the armature 21. The separation speed of the contacts in the vacuum chambers is the same regardless of whether drive is provided electrically or is emergency manual drive. The coil does not provide energy, that comes from the opening springs which must therefore be dimensioned accordingly.

Figure 5A:
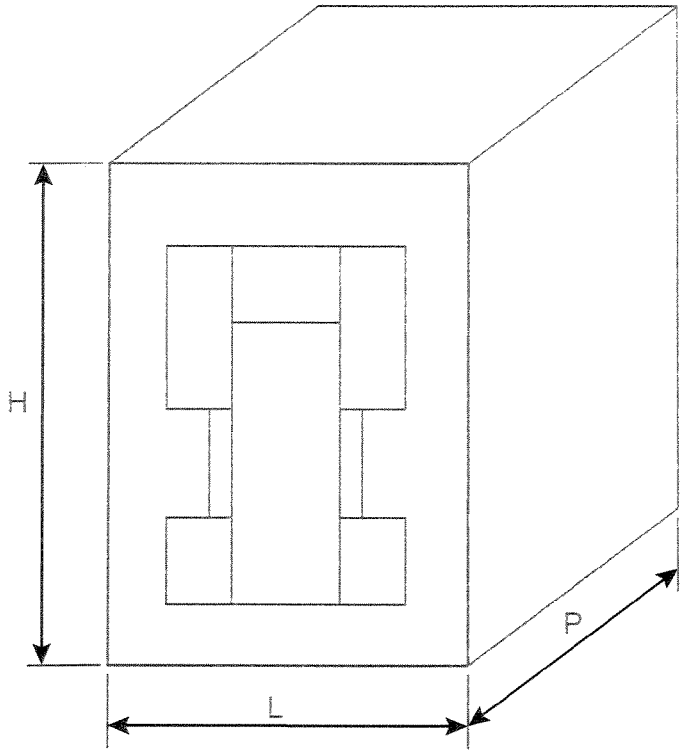
FIGS. 5A and 5B serve to compare the dimensions of a prior art actuator with the dimensions of an actuator in accordance with the invention.
Figure 5B:
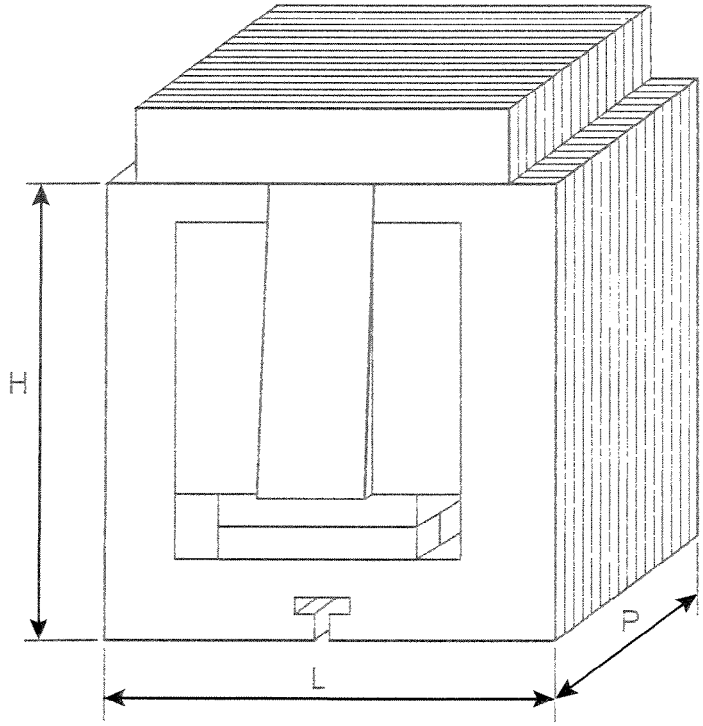

FIGS. 5A and 5B serve to compare the dimensions of two magnetic actuators, one being as described in patent application WO 96/32734 (FIG. 5A) and the other being in accordance with the invention (FIG. 5B). The FIG. 5A actuator can deliver a drive force of 20,000 N while the actuator of FIG. 5B delivers a drive force of 22,000 N. The overall dimensions of the FIG. 5A actuator are L=166 millimeters (mm), H=221 mm, and P=400 mm, whereas the overall dimensions of the FIG. 5B actuator are L=197 mm, H=205 mm, and P=220 mm. It is clear that the actuator of the invention is more compact.

It is explained above that the architecture of the actuator taking account of the flux entering and leaving the armature 21 enables the drive force to be doubled for identical sectional area of the intermediate leg. The quantity of material used when implementing this architecture is therefore less than that used when implementing the architecture described in patent application WO 96/32734. Such an actuator is therefore more favorable in environmental terms. The section of the yoke is about 130% the section of the intermediate leg since the flux traveling in the yoke is the same as the flux traveling in the intermediate leg. For the same number of turns and the same resistance, the section of the coil is smaller than that in patent application WO 96/32734 since the length of one turn of the coil is proportional to the perimeter of the section of the intermediate leg. The force-position characteristic of the actuator of the invention makes it particularly well suited for controlling vacuum circuit breakers.

The drawbacks associated with the interfering forces that might apply to the armature do not exist in the structure of the actuator of the invention. Guide parts presenting a low coefficient of friction that are difficult to install are unnecessary. The actuator is much less subject to the effects of interfering magnetic forces in the event of the armature being poorly positioned. The stroke of the armature can easily be adjusted, since the yoke does not limit this stroke as it does in the architecture of patent application WO 96/32734.

A significant advantage of the actuator of the invention compared with that described in patent application EP-A-1 225 609 is that a plurality of actuators presenting different drive forces can easily be obtained by using a greater or smaller number of parts for building the yoke, the armature, and the magnet. These parts are of simple shapes and there are no parts in the form of circular arcs as are to be found in patent application EP-A-1 225 609. The parts are easy to assemble. The airgap g3 between the armature 21 and the flux guide part 15 is easily determined since the chain of dimensions comprises fewer elements than in the configuration of patent application EP-A-1 225 609. No adjustment is necessary, as is not the case in the prior art where adjustment threads need to be used.

Although several embodiments of the present invention are shown and described in detail above, it will be understood that various changes and modifications can be applied thereto without going beyond the ambit of the invention.

The invention claimed is:

1. A magnetic actuator, comprising:

at least one coil surrounded by a magnetic circuit;

three legs comprising two outer legs on either side of the coil and an intermediate leg passing through the coil, the three legs having no direct mechanical contact with one another; and two facing end plates magnetically interconnecting the three legs, wherein the magnetic circuit comprises a moving armature comprising at least one of the end plates, wherein the magnetic circuit comprises a stationary portion including a yoke having at least an other one of the end plates, at least one permanent magnet, and a flux guide part inserted in the intermediate leg between the permanent magnet and the armature, the permanent magnet being placed at one end of the intermediate leg beside the end plate of the yoke, wherein a magnetic flux is established between the armature and the stationary portion to move the armature between an open position and a closed position, and wherein the two outer legs are parallelepipeds and extend substantially perpendicularly to the two end plates so that the magnetic flux extends in a moving direction of the armature.

2. A magnetic actuator according to claim 1, wherein the armature and the stationary portion are substantially complementary in shape with respect to the three legs.

3. A magnetic actuator according to claim 1, wherein the flux guide part is made of an iron-based material.

4. A magnetic actuator according to claim 1, wherein the flux guide part comprises two portions, one of the portions being of substantially constant section and extending inside the coil, and an other of the portions being of increasing section and extending from the coil towards the permanent magnet.

5. A magnetic actuator according to claim 1, wherein the armature is in a form of a plate, a T-shape, a U-shape, or an E-shape.

6. A magnetic actuator according to claim 1, wherein the yoke is in a form of a plate, a T-shape, a U-shape, or an E-shape.

7. A magnetic actuator according to claim 1, wherein the armature includes the intermediate leg and the yoke includes the two outer legs.

8. A magnetic actuator according to claim 1, wherein when the armature is in the closed position, the armature comes mechanically into contact with the yoke, at least via the two outer legs.

9. A magnetic actuator according to claim 1, wherein the yoke or the armature is laminated.

10. A magnetic actuator according to claim 1, wherein the yoke or the armature or the permanent magnet is built up of a plurality of touching parts.

11. A magnetic actuator according to claim 10, wherein the yoke, when U-shaped, is made up of two L-shaped parts touching face to face.

12. A magnetic actuator according to claim 10, wherein the armature, when T-shaped, is made up of two L-shaped parts touching back to back.

13. A magnetic actuator according to claim 1, wherein the end plate of the yoke includes a groove in a face of the end plate remote from the permanent magnet.

14. A magnetic actuator according claim 1, further comprising:

a plurality of fastening flanges secured to the yoke.

15. A mechanism for controlling contacts of one or more circuit breaker vacuum chambers, comprising:

an actuator according to claim 1.

* * * * *